US005170154A

United States Patent [19]

Mantopoulos et al.

[11] Patent Number: 5,170,154

[45] Date of Patent: Dec. 8, 1992

[54] BUS STRUCTURE AND METHOD FOR COMPILING PIXEL DATA WITH PRIORITIES

[75] Inventors: Thierry G. Mantopoulos; Fabrice M. Quinard, both of San Jose, Calif.

[73] Assignee: Radius Inc., San Jose, Calif.

[21] Appl. No.: 547,024

[22] Filed: Jun. 29, 1990

[51] Int. Cl.[5] ..... G09G 1/06; G09G 1/02

[52] U.S. Cl. ..... 340/723; 340/799

[58] Field of Search ..... 340/721, 723, 725, 701, 340/703, 750, 799

[56] References Cited

U.S. PATENT DOCUMENTS

| | | | |
|---|---|---|---|
| 4,233,601 | 11/1980 | Hankins et al. | 340/703 |
| 4,864,289 | 9/1989 | Nishi et al. | 340/725 |
| 4,951,229 | 8/1990 | DiNicola et al. | 340/725 |
| 4,992,781 | 2/1991 | Iwasaki et al. | 358/22 |

OTHER PUBLICATIONS

Markoff, John, "Personal Computers May Soon Add TV's Beauty," New York Times, pp. C1 and C5, Sep. 12, 1989.

Guglielmo, Connie and Battle, John, "RasterOps Cut Multimedia Costs," MacWeek, pp. 1 and 9, Feb. 6, 1990.

"DVA-4000/ISA" data sheet, Video Logic 1989.

Visual Communications, Inc., "D.FACTO," May 1989 pp. 1-20.

*Primary Examiner*—Ulysses Weldon
*Assistant Examiner*—M. Fatahiyar
*Attorney, Agent, or Firm*—Stuart P. Meyer

[57] ABSTRACT

A bus structure for coupling pixel data to control a raster-type display of objects that are represented by the pixel data in storage operates in real time to assemble pixel data for each pixel-count interval from the pixel data in a plurality of memory segments that are connected in cascade. Priority of displayable overlapping images is restored by comparing priority data stored with associated pixel data to transfer from memory and along the bus structure the pixel data for a pixel-count interval that has the highest associated priority data.

2 Claims, 5 Drawing Sheets

NOTATION:

N ON 'n' BIT
$F = N/2^n$

R ON 'r' BIT
$F = R/2^r$

ALGORITHM:

$$R_x = N_{(x) \bmod n} \text{ with } x = 0 \text{ to } r-1$$

EXAMPLE:

N =

IF r=7 R=

IF r=2 R=

BUS STRUCTURE AND METHOD FOR COMPILING PIXEL DATA WITH PRIORITIES

RELATED APPLICATIONS

The subject matter of this application relates to the subject matter set forth in the following pending, issued or abandoned U.S. patent applications: Ser. No. 07/547,060, entitled "Graphic Animation System and Method," filed on June 29, 1990 by Pierre-Alain Cotte, et al.; Ser. No. 07/546,916, entitled "Method and Means for Manipulating Pixel Data," filed on June 29, 1990 by Pierre-Alain Cotte, et al.; Ser. No. 07/546,712, entitled "Memory Structure and Method for Managing Pixel Data," filed on June 29, 1990 by Pierre-Alain Cotte, et al. (abandoned); Ser. No. 07/546,915, entitled "Method and Apparatus for Binary Value Modification by a Percentage," filed on June 29, 1990 by Thierry Mantopoulos; Ser. No. 07/547,023, entitled "Phase Locked Loop Having Sampling Gate Phase Detector", filed on June 29, 1990 by Thierry Mantopoulos and Fabrice Quinard (now issued U.S. Pat. No. 5,061,904); Ser. No. 07/547,026, entitled "Video Synchronization Generator and Method," filed on June 29, 1990 by Fabrice Quinard (abandoned); and Ser. No. 07/546,711, entitled "Video FIFO Buffer and Method," filed on June 29, 1990 by Fabrice Quinard.

BACKGROUND OF THE INVENTION

This invention relates to bus structures for computers and more particularly to the structure by which blocks of pixel data for a raster-type display can be compiled in real time from multiple memory planes with associated priorities for the blocks of pixel data from selected memory planes.

SUMMARY OF THE INVENTION

In accordance with the present invention images which are to be displayed in a raster-type display are controlled by pixel data that is retrieved in real time from bit-mapped locations in a plurality of memory planes (or, in a plurality of sections of a memory plane). The blocks of pixel data associated with separate bit-mapped images may be accorded selected priorities in order to compile overlapping images on the display in accordance with selected near-far orientation priorities. Thus, an image of a house may be displayed in overlapping priority relative to the image of a tree which in turn may be displayed in overlapping priority relative to the displayed image of a mountain, and so on, where the image of each displayed object may be compiled from pixel data that is conveniently bit-mapped into individual memory planes. In this way, priorities for each object can be altered to modify the overlapping near-far orientations of the objects in a composite display.

DESCRIPTION OF THE PREFERRED EMBODIMENT

Figure 1:
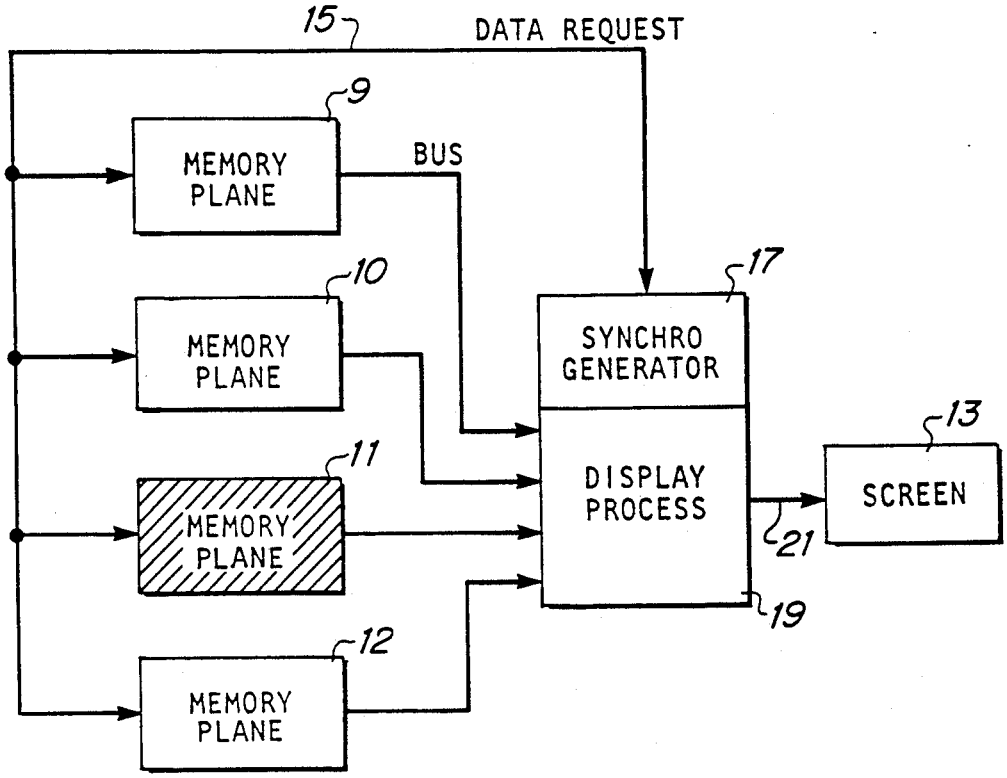
Figure 1 (PRIOR ART)
FIG. 1 is a schematic diagram of a conventional structure for combining multiple sources of pixel data.

Referring now to FIG. 1, there is shown a simplified block schematic diagram of conventional circuitry commonly used to compile real time pixel data from multiple memory planes 9–12, each associated with a displayable image, into a horizontal scan line of data for application to and control of a raster type display screen 13. Selective accessing of pixel data from a memory plane 9–12 for a particular displayable image is under control of data requests 15 (typically, address information per plane) provided by synchronizing generator 17. In addition, the accessed pixel data is compiled in real time in a display processor 19 which may include a multiplexer or an OR gate and a digital to analog converter for producing display-controlling signals 21 that provide the desired display of the images in memories 9–12 on display screen 13. However, in such conventional systems the volume of pixel data that must be assembled in real time, typically in 32-bit blocks containing Red, Green and Blue (RGB) data for each pixel, imposes stringent timing requirements for operation at about 15–30 MHz rates, and requires expensive electronic components to implement.

Figure 2:
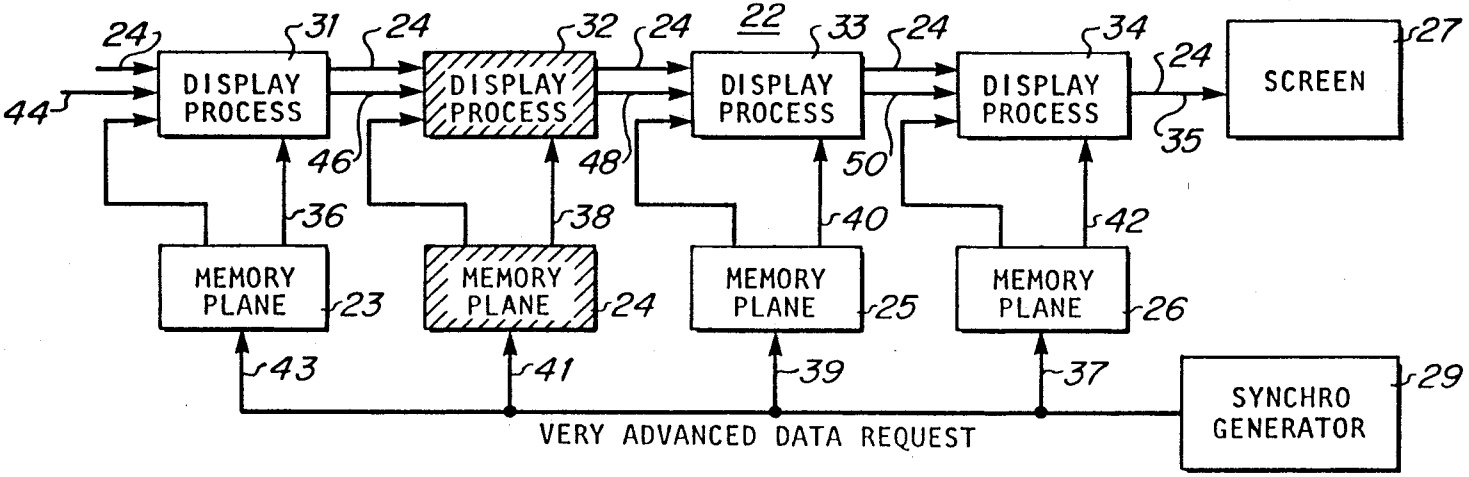
FIG. 2 is a pictorial and schematic diagram of the illustrated embodiment of the present invention.

In accordance with the embodiment of the present invention that is illustrated in FIG. 2, the pixel data associated with displayable images stored in bit-mapped memory planes 23–26 are accumulated or cascaded along a pixel data bus 22 in a synchronous daisy-chain configuration for compiling pixel data in real time per displayable line of data applied to raster-type display 27. Each memory plane 23–26 may have an image or images bit-mapped therein at selected addresses for retrieval and application to the bus structure in successive clock intervals under the control of synchronous generator 29. The pixel data that is retrieved from each memory plane 23–26 is combined on the bus 22 via display processor or operator 31–34, as described in detail later herein. In this manner, several memory planes and the displayable images stored in bit-mapped orientation at addressable locations therein may be added into the bus structure, with associated timing controls supplied thereto from the synchronous generator 29. If each memory plane 23–26 and associated operator or data processor 31–34 required one clock interval for access and transfer of stored pixel data from memory to the bus structure 22, then with reference to the time when signals 35 are required to be supplied to the display screen 27, each memory plane 23–26 and associated operator 31–34 preceding the output 35 of the bus structure 22 requires address and data requests from the synchronous generator 29 at progressively earlier or advanced intervals. Thus, for example, memory plane 26 requires data request control signals 37 one interval earlier than the output 35 is required, memory plane 25 requires data request control signals 39 two intervals earlier, memory plane 24 requires data request control signals 41 three intervals earlier, and so on for all N number of memory planes 23–26 and associated operators 31–34 with bus structure 22. Such uniform data transfer interval may be encountered in memory planes 23-26, which may be actually only different segments of a single, larger memory plane.

More importantly, in accordance with the present invention, several different types of memory planes having different access and retrieval delay intervals can be cascaded along the bus structure 22 without limitation beyond the requirement for sufficiently advanced data request control signals 37-43 being supplied in advance to facilitate all data transfers onto the bus in real time for complete compilation when required at output 35 for application to display screen 27 as a complete horizontal scan line of pixel data. Of course, since all pixel data is not required by the display device 27 at the same time, a particular block of pixel data 35 may only be needed at a particular pixel count along the display positions of a horizontal scan line on the display screen 27. Then the pixel data retrieved from the memory planes 23-26 may be "pipelined" in real time along the bus structure 22 to arrive at the output 35 at a particular pixel count interval of the display screen 27.

Figure 3:
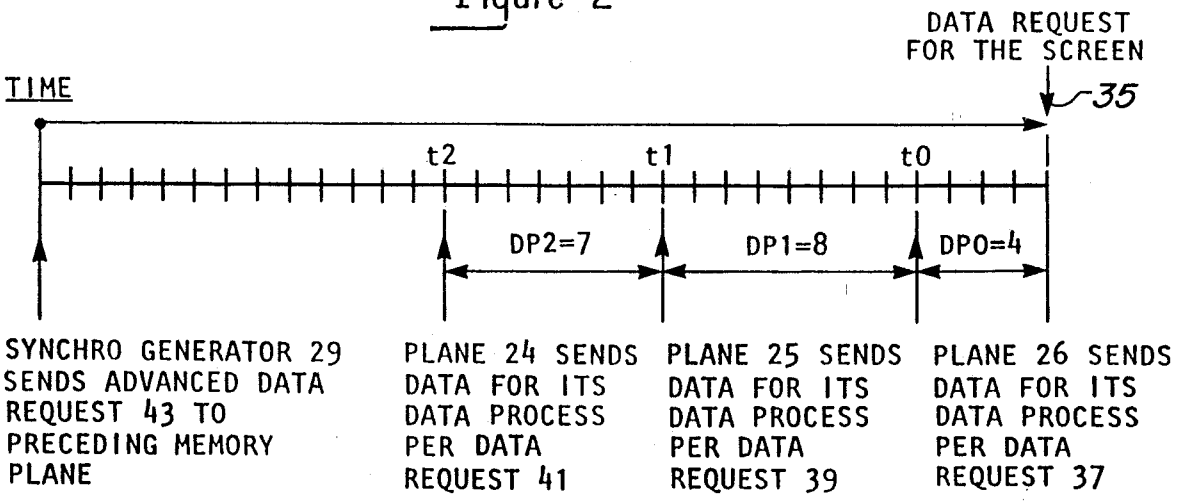
FIG. 3 is a graph illustrating the timing of events in the operation of the embodiment of FIG. 2.

Referring then to the graph of FIG. 3, there is shown an accumulation of advanced data requests to each memory plane that are determined by the summation of different data transfer delays of all succeeding memory planes along the bus structure 22 to the output 35. Thus, data retrievals and transfers from the memory planes 23-26 to and along the bus structure 22 proceed at the pixel clock rate (typically 15-30 MHz) determined by the raster-type display screen 27. A register in each processor 31-34 may store the requisite delay for access and transfer to the bus structure 22 of pixel data stored in the associated memory plane 23-26, and generator 29 need only respond to the data in such registers to determine the cumulative lead intervals by which to initiate the data requests 37-43.

Figure 4:
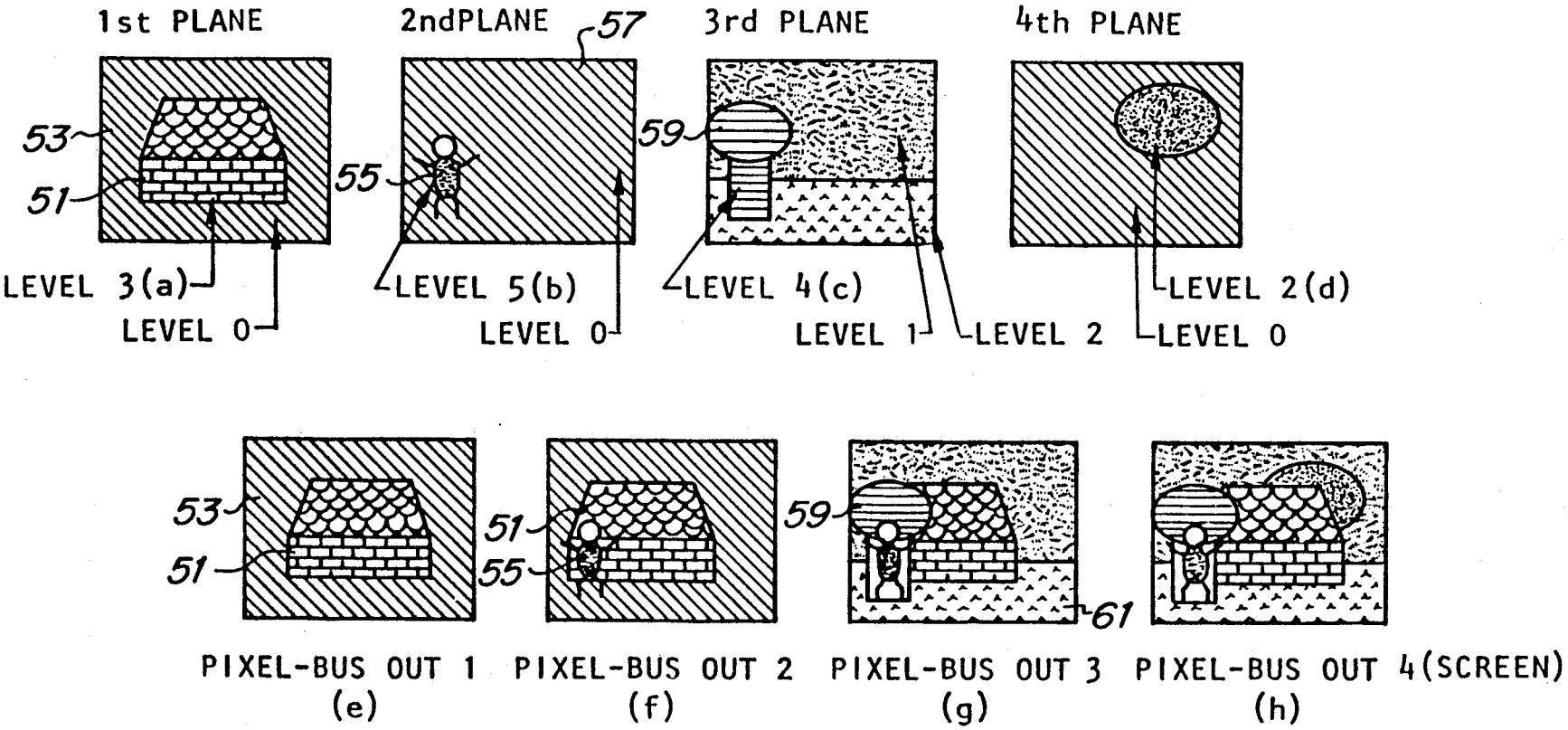
FIGS. 4 (*a*)–(*h*) are pictorial illustrations of displayable images that are bit-mapped in memory planes or equivalently available in real time.

It should be noted that where displayable images which are stored in memory planes 23-26 are to be compiled for overlapping display on display 27, the pixel data retrieved from later memory planes in the bus structure 22 (e.g., 25, 26) might normally attain image priority by obliterating the pixel data retrieved from earlier memory planes in the bus structure 22 (e.g., 23-24) for the same (i.e., overlapping) pixel count. However, in accordance with the present invention, such image priorities (giving rise to near-far orientation priorities as displayed) may be resolved independent of the connected sequence of a memory plane along the bus structure 22 from which pixel data for a displayable image is retrieved. Thus, with reference to FIGS. 4 *a*)-*d*), there are shown the pictorial equivalent of blocks of pixel data as bit-mapped into each memory plane 23-26. The pixel data for each stored image has associated therewith per pixel one or more priority bits to indicate different priority zones, to associate priority with pixel position, to associate priority with color, and to associate priority with region. Thus, as illustrated in FIG. 4(*a*), the pixel data for each pixel associated with the image of, say, a house 51 includes at least one bit of data that designates the separation between priority regions (house 51 v. background 53) and that designates the level of priority assigned to each region (higher numbers designate nearer field or closer positional orientation when displayed), in addition to RGB data, and the like. This pixel data may be stored in any of the memory planes 23-26 along the bus structure without loss of control of assigned priorities for reasons as later described herein. Similarly, the pixel data associated with the FIG. 55 in FIG. 4(*b*) may include bits designating priority zones 55 and 57 and priority level (e.g., 5), in addition to RGB data, and such data may be stored in any other memory 23-26 connected in the bus structure 22. Similarly, the pixel data associated with other displayable images, as illustrated in FIGS. 4(c) and (d) include bits of data to designate priority zones and priority levels, in addition to RGB data, and the like.

Figure 8:
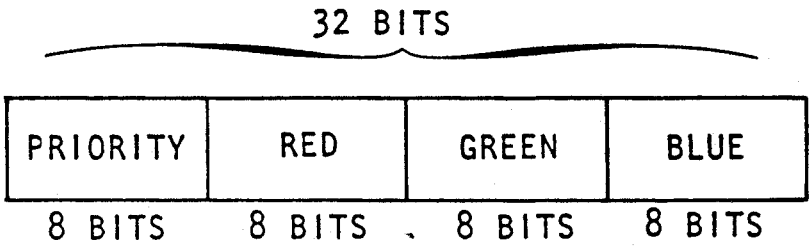
FIG. 8 is a pictorial representation of pixel data with associated priority value.

The priority data 36, 38, 40, 42 associated with each pixel of a stored image is accessed and transferred 44, 46, 48, 50 along the bus structure 22 from each memory plane 23-26 in order to determine at each operator 31-34 whether a block of pixel data of lower priority will be exchanged for a block of priority for a given pixel count (i.e., in overlapping relationship). Therefore, FIGS. 4(*e*)-(*h*) pictorially illustrate the equivalent displays of all compiled pixel data (over all pixel counts for all horizontal scan lines for one frame of display) available at the outputs of each of the display processors or operators 31-34, delayed successively in time per position of the associated memory plane along the bus structure 22. Specifically, as illustrated in FIG. 4(e), pixel data associated with the house is assigned higher priority level than the background pixel data, so the equivalent display based on pixel data available at the output of operator 31 is as illustrated in FIG. 4(*e*). Then, the combined pixel data with associated priority zones and levels that are compiled from the pixel data transferred along the bus structure 22 from memory plane 23, and accessed from memory plane 24 yields the equivalent display illustrated in FIG. 4(*f*) (for all pixel data for all horizontal scan lines for one frame of display). It should be noted that, because of the assigned values of priority zones and levels for the background 53, 57, house 51 and FIG. 55, the pixels for the FIG. 55 overlay or replace the pixels for the house which, in turn, overlay or replace the background pixels 53 and 57. Similarly, for the priority zones and levels associated with pixel data for the images illustrated in FIG. 4(*c*) stored in memory plane 25, the compiled pixel data available at the output of operator 33 yields the equivalent display (under the conditions referred to above), as illustrated in FIG. 4(*g*). There, due to the priority values for zones and levels stored in memory plane 25, the pixels for the FIG. 55 overlay the pixels for the tree and the house and backgrounds, and the pixels for the tree overlay the pixels for the house and backgrounds, and the pixels for the house overlay the backgrounds and the lower background 61 overlays the upper background 53, 57. Finally, in similar manner, the pixel data and associated values for priority zones and levels of the images stored in memory plane 26, as illustrated in FIG. 4(*d*), are compiled with pixel data and priority values transferred along the bus structure 22 from preceding memory planes 23-25 to yield the equivalent the display (under the conditions referred to above) as illustrated in FIG. 4(*h*). Such compiled pixel data, of course, constitutes the pixel data at the output 35 of the bus structure 22 that drives the display 27 at all pixel counts along all horizontal scan lines to yield the display frame illustrated in FIG. 4(*h*) including all of the stored images displayed in overlapping (and obliterating) orientations. Thus, pixel data for all pixels along a given horizontal scan line are compiled as a string of blocks of pixel data, wherein in the pixel data for a given pixel count from two or more memory planes (i.e., overlapping relationship of displayable objects) is evaluated for priority values, and the pixel data for a given pixel count having a certain lower priority value is exchanged for the pixel data for the same pixel count having a corresponding higher priority value. Conflicts in priority values (e.g., equality in zone or level) may be resolved, for example, with reference to priority value of another attribute of the displayable image (for example, color). Thus pixel data associated wi backgrounds at conflicting priority levels for different displayable objects may be resolved exchanging pixel data including light blue information (e.g., sky) for pixel data including dark blue information (e.g., water). The format of pixel data with priority value is illustrated in FIG. 8.

Figure 5:
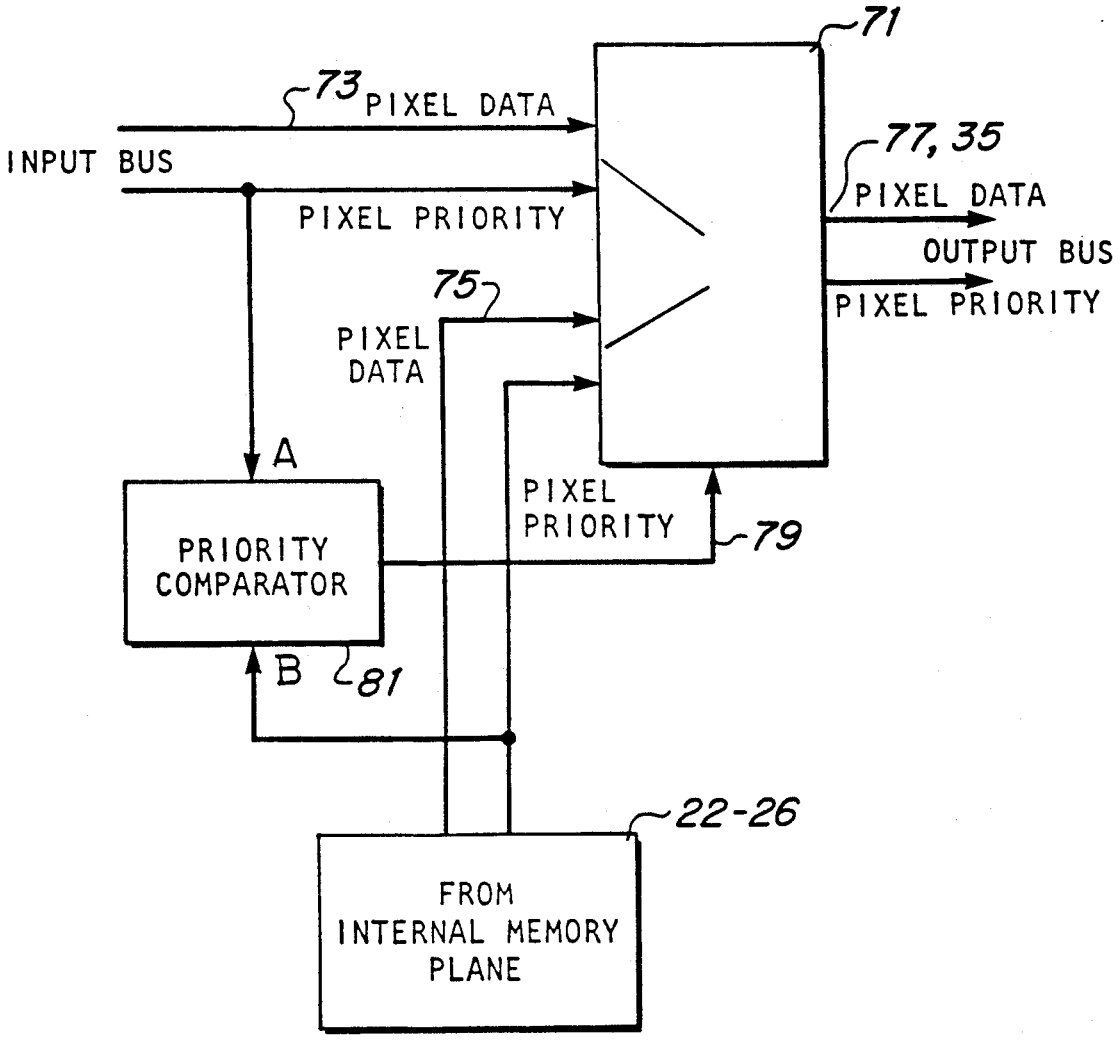
FIG. 5 is a block diagram of one embodiment of bus operators for compiling pixel data along the bus structure of the present invention.

Referring now to FIG. 5, there is shown a block schematic diagram of the display processors or operators 31–34 Each such operator includes a multiplexer 71 having pixel data inputs 73, 75 for receiving pixel data on the bus structure 22 and from the associated memory plane for connecting one of the set of inputs to the output 77 in response to a priority control input 79. A comparator 81 is coupled to receive the priority data A associated with pixel data on the bus structure 22, and the priority data B associated with the pixel data from a memory plane to supply a control signal 79 to the multiplexer 71. In response to such control signal, the multiplexer 71 conducts to the output thereof the pixel data (and associated priority data) on the bus or from the memory plane that has the highest priority. Such pixel data with associated priority data thus propagates along the bus structure in real time until exchanged for pixel data having higher priority values, with the result that the pixel data with the associated highest priority data is presented at the output 35 to drive the display screen 27.

Figure 6:
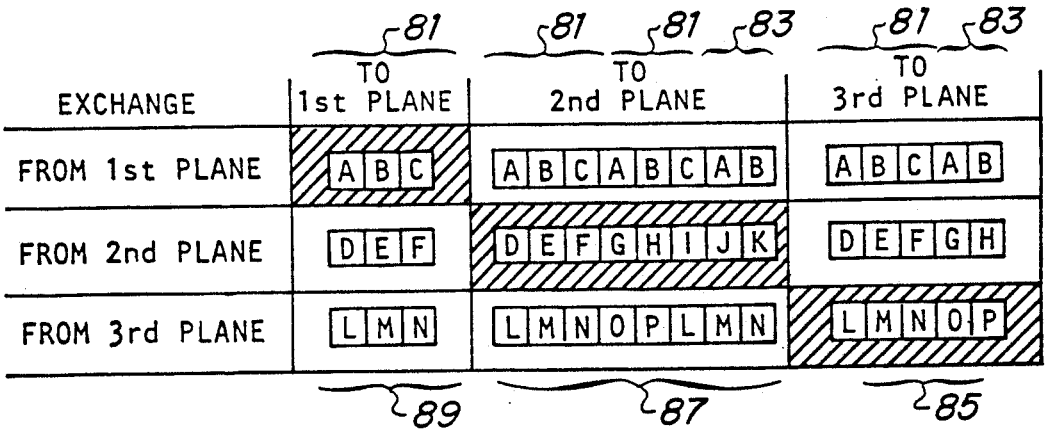
FIGS. 6 and 7 are pictorial representations of pixel data from different memory planes in different data formats.
Figure 7:
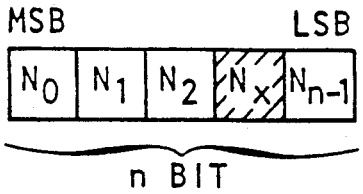
Figure 7:
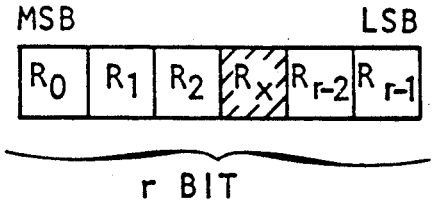
Figure 7:
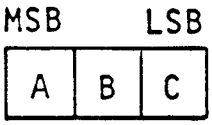
Figure 7:
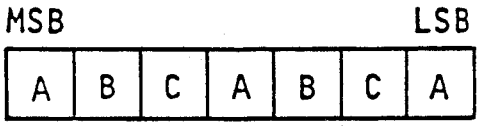
Figure 7:
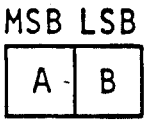

Referring now to FIG. 6, there is shown a pictorial representation of pixel data in three different formats from three different memory planes 23–26. In accordance with the present invention, different types of memory planes having different data access and transfer delays and also having different formats for storing pixel data can be connected in cascade or daisy-chain bus configuration, as illustrated in FIG. 2. Specifically, if the bus structure 22 is capable of handling 8-bit (maximum) pixel data, then memory planes 23–26 storing pixel data in format containing fewer bits can also operate compatibly on the bus in accordance with another aspect of the present invention. It should be noted that it is not sufficient to add non-significant zeros to pixel data of fewer bits in order to fill 8-bit data format. This is because the fewer data bits, rounded out to 8-bit format, cannot completely represent the full range (for example, of gray scale) represented by 8-bit format. Three-bit data in the range from 000 to 111 can be rounded out in 8-bit format to 000+00000 through 111+00000 (or 000+11111 through 111+11111), which does not cover the full 8-bit range of data in the converted format. Therefore, in accordance with the present invention, the subset block of pixel data 81 (say, in 3-bit format) is replicated as a block of data within the next less significant bit positions 81, with the remainder of the 8-bit format replicated from the most significant data bits 83 to yield substantially the same fraction of range represented by the different N-bit data formats. Similarly, 5-bit data format 85 may be converted to 8-bit data format 87, and to 3-bit data format 89, as described above, in accordance with the following algorithm:

$$R_x = N_{(x) mood\ in} \quad \text{(Eq. 1)}$$

where $0 \leqq x \leqq r-1$; r is the number of bits in the format to which data is converted and n is the number of bits in the format from which the data is converted, $R_x$ is the value of the xth bit of the new r-bit number and $N_{(x)}$ mood n is the value of the (x) mod n - th bit of the original n-bit number. Excess data bits in the replicated, converted data format can be resolved by dropping the least significant data bit(s) in the data block with least significant bit positions of the converted data format. Thus, the fractional quantities are approximately the same over the full range of values covered in the format to which data bits are converted as illustrated in FIG. 7:

$$\text{Fraction} = \frac{R}{2^r} \text{ (for } r\text{-bit format)} \quad \text{(Eq. 2)}$$

$$\text{Fraction} = \frac{N}{2^n} \text{ (for } n\text{-bit format)} \quad \text{(Eq. 3)}$$

By this data conversion, substantially the entire range of values in a reference data format can be covered with substantial linearity over the range of data in the format from which the pixel data is converted.

Therefore, the present bus structure facilitates the compilation in real time of the pixel data required to display multiple overlapping objects on a raster-type display. In addition, the present bus structure resolves priorities for pixel data of overlapping objects independent of orientation of a memory plane containing the pixel data for a displayable object along the cascaded bus structure.

What is claimed is:

1. Apparatus for assembling pixel data during recurring intervals from pixel data, including priority data, for displayable objects stored in a plurality of memory segments, the apparatus comprising:

first processor means for a first memory segment comprising:

(i) first switch means having a pair of inputs and having an output for selectively coupling to one of the pair of inputs thereof in response to a first applied control signal;

(ii) means coupling the output pixel data from a preceding processor means to one of said pair of inputs of said first switch means;

(iii) means coupling the pixel data from said first memory segment to the other of said pair of inputs of said first switch means;

(iv) first comparator means having a first pair of control inputs and having a first control output coupled to apply said first applied control signal to said first switch means representative of priority data received at the first pair of control inputs attaining a selected relationship;

(v) means coupling to one of the first pair of control inputs the priority data associated with pixel data received from said preceding processor means;

(vi) means coupling to another of the first pair of control inputs the priority data associated with pixel data received from the first memory segment for controlling the first switch means to pass to the output thereof the pixel data received at one of said pair of inputs thereof having the associated priority data which attained said selected relationship; said first processor means producing therefrom output pixel data representative of the pixel data received thereby having greater priority data associated therewith;

second processor means for a second memory segment comprising:

(i) second switch means having a pair of inputs and having an output for selectively coupling to one of the pair of inputs thereof in response to a second applied control signal;

(ii) means coupling the output pixel data from the first processor means to one of said pair of inputs of said second switch means;

(iii) means coupling the pixel data from said second memory segment to the other of said pair of inputs of said second switch means;

(iv) second comparator means having a second pair of control inputs and having a second control output coupled to apply said second control signal to said second switch means representative of priority data received at the second pair of control inputs attaining said selected relationship;

(v) means coupling to one of the second pair of control inputs the priority data associated with pixel data received from said first processor means;

(vi) means coupling to another of the second pair of control inputs the priority data associated with pixel data received from the second memory segment for controlling the second switch means to pass to the output thereof the pixel data received at one of said pair of inputs thereof having the associated priority data which attained said selected relationship; said second processor means producing therefrom output pixel data representative of the pixel data received thereby having greater priority data associated therewith; and synchronizing means coupled to actuate retrieval of pixel data from said first memory segment in an interval preceding an interval in which pixel data is retrieved from said second memory segment for producing therefrom pixel data during recurring intervals.

2. Apparatus as in claim 1 wherein at least said first processor means also passes to the output thereof the priority data received thereby for which the associated priority data attains the highest value.

* * * * *

UNITED STATES PATENT AND TRADEMARK OFFICE

CERTIFICATE OF CORRECTION

PATENT NO. : 5,170,154

DATED : December 8, 1992

INVENTOR(S) : Thierry G. Mantopoulos and Fabrice Quinard

It is certified that error appears in the above-identified patent and that said Letters Patent is hereby corrected as shown below:

On the title page, Item
[54] References Cited, line 1: "BUS STRUCTURE AND METHOD FOR" should be --BUS STRUCTURE FOR--

Col. 1, line 1, "BUS STRUCTURE AND METHOD FOR" should be --BUS STRUCTURE FOR--

Col. 4, line 15, "will be exchanged for a block of" should be --will be exchanged for a block of pixel data of higher--

Col. 5, line 8, "ple, color). Thus pixel data associated wi backgrounds" should be --ple, color). Thus pixel data associated with the backgrounds--

Col. 5, line 67, "$R_x = N_{(x)}$ mood in (Eq.1)" should be --$R_x = N_{(x)}$ mod n (Eq.1)--

Col. 6, line 3, "mood" should be --mod--

Signed and Sealed this

Seventh Day of December, 1993

Attest:

Bruce Lehman

BRUCE LEHMAN

Attesting Officer

Commissioner of Patents and Trademarks